US007966787B2

(12) United States Patent
Guo et al.

(10) Patent No.: US 7,966,787 B2
(45) Date of Patent: Jun. 28, 2011

(54) VACUUM DEVICE AND METHOD FOR PACKAGING SAME

(75) Inventors: Cai-Lin Guo, Beijing (CN); Peng Liu, Beijing (CN); Pi-Jin Chen, Beijing (CN); Bing-Chu Du, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 59 days.

(21) Appl. No.: 12/479,944

(22) Filed: Jun. 8, 2009

(65) Prior Publication Data

US 2009/0313946 A1 Dec. 24, 2009

(30) Foreign Application Priority Data

Jun. 18, 2008 (CN) ..... 2008 1 0067909

(51) Int. Cl.

| | |
|---|---|
| ***B65B 31/00*** | (2006.01) |
| ***H01J 9/385*** | (2006.01) |
| ***H01J 9/40*** | (2006.01) |
| ***B65D 81/20*** | (2006.01) |

(52) U.S. Cl. ..... 53/405; 53/86; 206/524.8; 445/25

(58) Field of Classification Search ..... 53/403–405, 53/408, 79, 80, 86; 206/524.8; 445/24, 25; *H01J 9/385, 9/39, 9/40*

See application file for complete search history.

(56) References Cited

U.S. PATENT DOCUMENTS

| | | | | | |
|---|---|---|---|---|---|
| 2,894,294 | A | * | 7/1959 | Prescott | 65/43 |
| 2,988,852 | A | * | 6/1961 | Henry | 65/34 |
| 3,826,634 | A | * | 7/1974 | Blust et al. | 53/403 |
| 3,914,000 | A | * | 10/1975 | Beckerman et al. | 445/25 |
| 4,182,540 | A | * | 1/1980 | Frankland et al. | 445/25 |
| 4,582,210 | A | * | 4/1986 | Morimoto et al. | 445/25 |
| 4,675,987 | A | * | 6/1987 | Minks et al. | 53/404 |
| 4,770,310 | A | * | 9/1988 | Morimoto et al. | 220/2.2 |
| 5,072,574 | A | | 12/1991 | Puett | |
| 5,477,008 | A | * | 12/1995 | Pasqualoni et al. | 174/539 |
| 5,759,668 | A | * | 6/1998 | Ishikawa et al. | 53/403 |
| 5,797,780 | A | * | 8/1998 | Peng | 445/25 |
| 5,921,837 | A | * | 7/1999 | Kanagawa et al. | 445/25 |
| 6,416,831 | B1 | * | 7/2002 | Hara et al. | 206/524.8 |
| 2001/0007805 | A1 | * | 7/2001 | Saeki | 445/25 |
| 2006/0063462 | A1 | * | 3/2006 | Ding et al. | 445/25 |

FOREIGN PATENT DOCUMENTS

| | | | | |
|---|---|---|---|---|
| CN | 1801432 | A | | 7/2006 |
| CN | 101162672 | A | | 4/2008 |
| JP | 63116336 | A | * | 5/1988 |
| JP | 11306983 | A | * | 11/1999 |
| JP | 2000208051 | A | * | 7/2000 |

* cited by examiner

*Primary Examiner* — Stephen F Gerrity
(74) *Attorney, Agent, or Firm* — Clifford O. Chi

(57) ABSTRACT

A method for packaging the vacuum device includes providing a pre-packaged container having an exhaust through hole defined therein and a sealing element placed into the exhaust through hole, pumping the pre-packaged container to create a vacuum, heating and softening the sealing element to seal the exhaust through hole, and cooling the melted low-melting glass to package the pre-packaged container.

9 Claims, 10 Drawing Sheets

VACUUM DEVICE AND METHOD FOR PACKAGING SAME

BACKGROUND

1. Technical Field

The present disclosure relates to packaging technologies and, in particular, to a vacuum device and a method for packaging the same.

2. Description of Related Art

Some vacuum devices, such as flat panel displays, are packaged by a vacuum packaging system to create a vacuum within such devices. Referring to FIG. 7, a typical packaging method of a pre-packaged container 100 includes the following steps. The pre-packaged container 100, which has an exhaust through hole 102 defined therein, is prepared. An exhaust pipe 110 is provided. One end of the exhaust pipe 110 is inserted into and fixed in the through hole 102 via low-melting glass material 108, and another end of the exhaust pipe 110 is exposed outside of the pre-packaged container 100. A cup-shaped connector 104, which connects to a vacuum pump 106, is provided. The cup-shaped connector 104 covers the exhaust pipe 110 to create a vacuum in the pre-packaged container 100 via the vacuum pump 106. One end of the exhaust pipe 110 is sealed utilizing a condensing-light sealing device 112 to obtain a packaged container (not shown) under vacuum. The condensing-light sealing device 112 is used to heat and soften the exhaust pipe 110 so as to seal the opening thereof.

Alternatively, the pre-packaged container 100 may be placed into a vacuum room 114 as shown in FIG. 8. When the vacuum is created in the vacuum room 114 via the vacuum pump 106, a vacuum also is created in the packaged container (not shown). The open end of the exhaust pipe 110 can be then sealed via a condensing-light sealing device 116.

However, the prepackaged container is disadvantageous with respect to safety and reliability because the exhaust pipe 110 needs to be disposed on the through hole 102 of the pre-packaged container 100, and the exhaust pipe 110 is retained outside of the packaged container. Furthermore, to expediently seal the open of the exhaust pipe 110, the exhaust pipe 110 must have a small diameter, for example, less than 5 mm, which, in turn, requires more time to remove air from the pre-packaged container 100. Therefore, the structure of the packaged container becomes complicated and the manufacturing cost is increased.

What is needed, therefore, is a vacuum device and a packaging method for the vacuum device, which can overcome the above-described shortcomings.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Referring to FIGS. 1-2 and 3A-3C, a method of packaging a vacuum device is shown. Depending on the embodiment, certain of the steps described below may be removed, others may be added, and the sequence of steps may be altered. It is also to be understood that the above description and the claims drawn to a method may include some indication in reference to certain steps. However, the indication used is only to be viewed for identification purposes and not as a suggestion as to an order for the steps. The method includes:

step S101: providing a pre-packaged container 30 having an exhaust through hole 301 defined therein and a sealing element 31 having a through hole 311 defined therein;

step S102: placing the sealing element 31 into the exhaust through hole 301;

step S103: creating a vacuum in the container 30;

step S104: heating and softening the sealing element 31 into viscous liquid to seal the exhaust through hole 301;

step S105: cooling down the sealing element 31 to from the seal between the vacuum device with the sealing element 31 to obtain the vacuum device.

Figure 1:
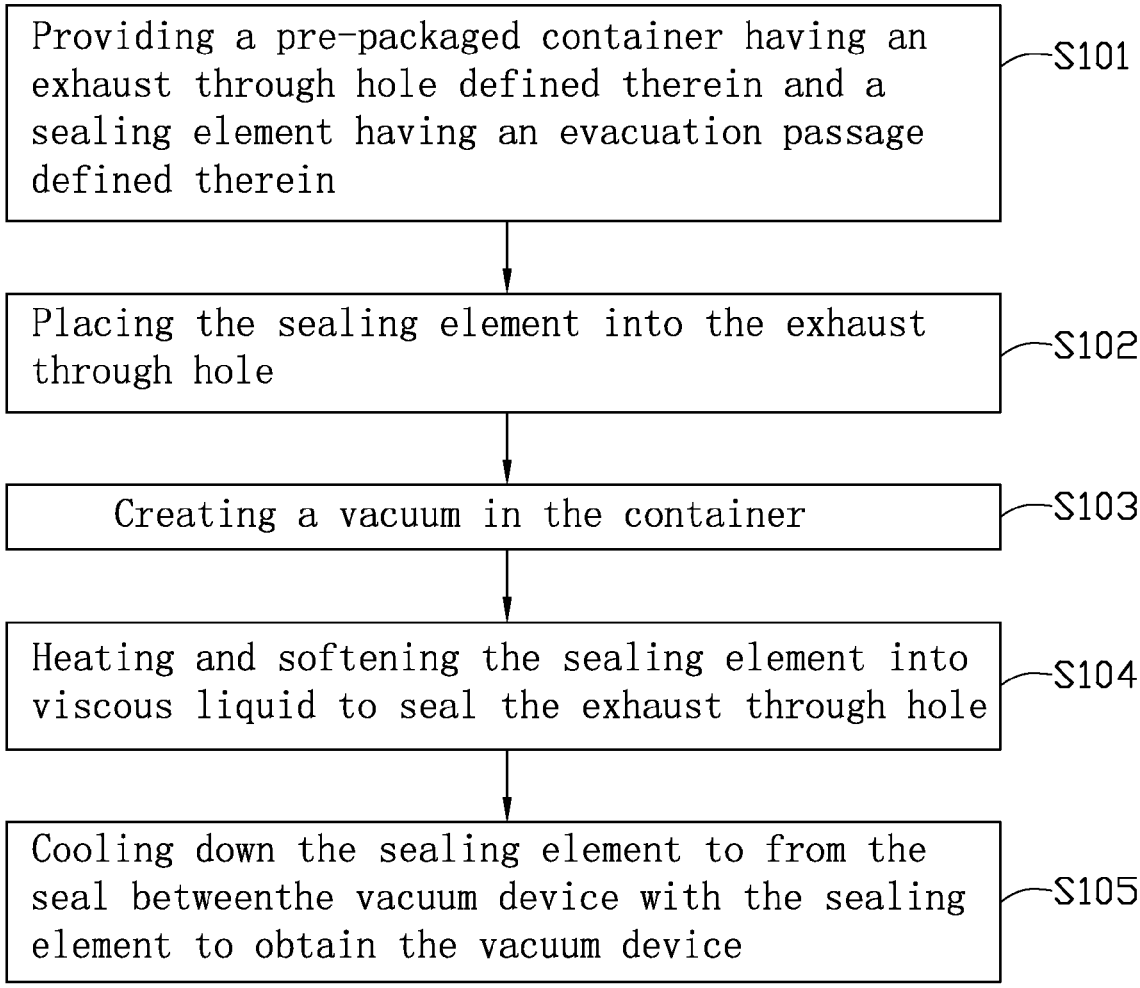
FIG. 1 is a flowchart of an embodiment of a packaging method for an embodiment a vacuum device, the vacuum device including a pre-packaged container and a sealing element.
Figure 2:
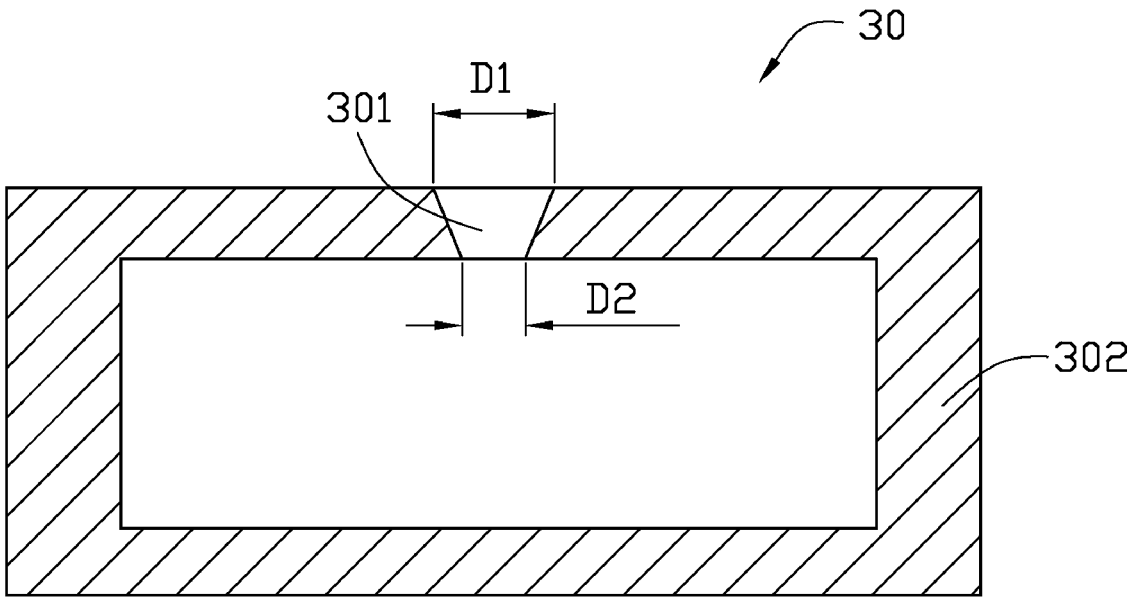
FIG. 2 is a schematic, cross-sectional view of the pre-packaged container.

In step S101, referring to FIG. 2, the pre-packaged container 30 includes a housing 302 and the exhaust through hole 301 defined therein. The housing 302 may be made of glass, metal, or any other material that can support an internal vacuum pressure. In the present embodiment, the housing 302 is made of glass. It should be further noted that the pre-packaged container 30 may be an element of a flat panel display, in which case the housing 302 would include a rear plate, a front plate, and spacers disposed between the rear plate and the front plate (not labeled). Some electronic elements (not shown) are mounted in the housing 302 to serve as some function elements, such as displaying elements. The exhaust through hole 301 can be defined in any of one sidewall of the housing 302 and has an appropriate size to the volume of the housing 302. The exhaust through hole 301 includes an upper diameter $D_1$ and a lower diameter $D_2$. The upper diameter $D_1$ is greater than the lower diameter $D_2$, to prevent the sealing element 31 from falling into the pre-packaged container 30. In the present embodiment, the exhaust through hole 301 is at a top sidewall of the housing 302 such that the upper diameter $D_1$ is above the lower diameter $D_2$, to prevent the sealing element 31 from falling into the pre-packaged container 30, due to gravity. The exhaust through hole 301 may have a cross-sectional shape such as a step shape and taper shape. In the present embodiment, the exhaust through hole 302 has a tapered shape, with the upper diameter $D_1$ at about 10 mm, and the lower diameter $D_2$ at about 2 mm. However, it is understood the size of the exhaust through hole 22 must be sized accordingly to the volume of the container, otherwise a poor reliability would result.

The sealing element 31 is made of a low-melting point material, such as glass, or metal, so long as the molten sealing element 31 would be retained in the exhaust through hole 301.

Figure 3A:
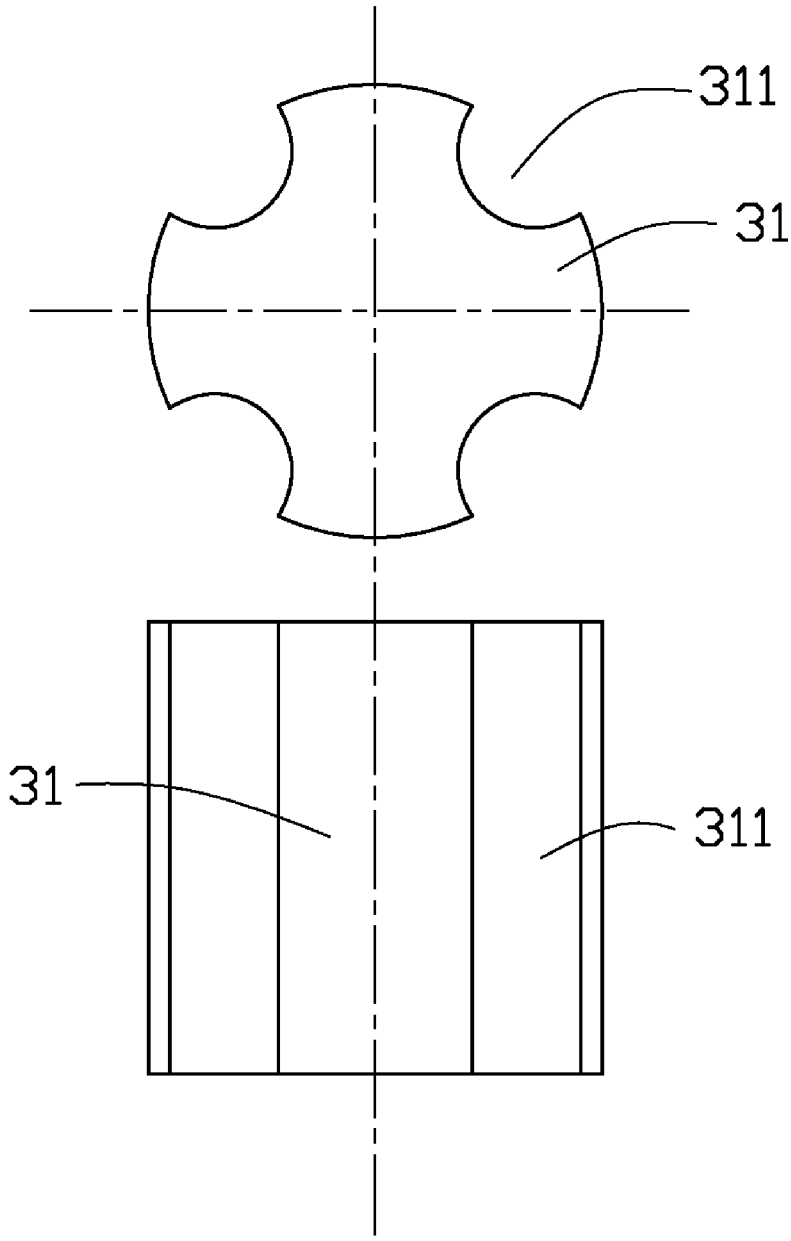
FIG. 3A-3C is a schematic, cross-sectional, and top view of the sealing element.
Figure 3B:
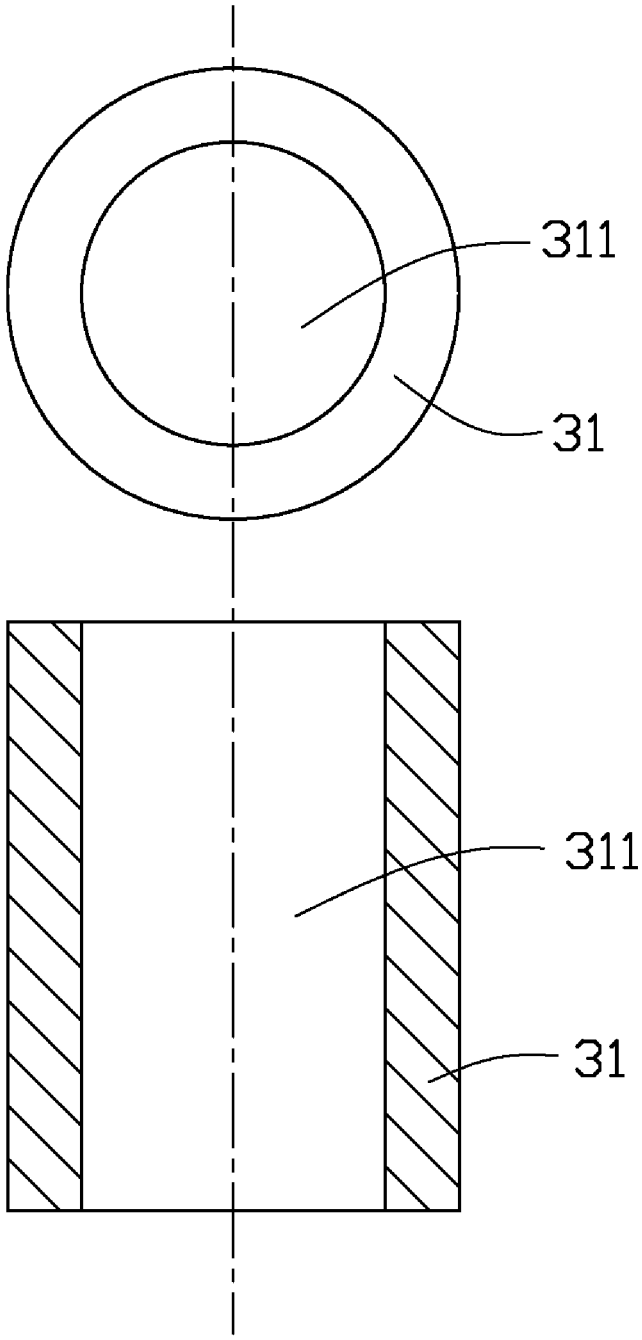
Figure 3C:
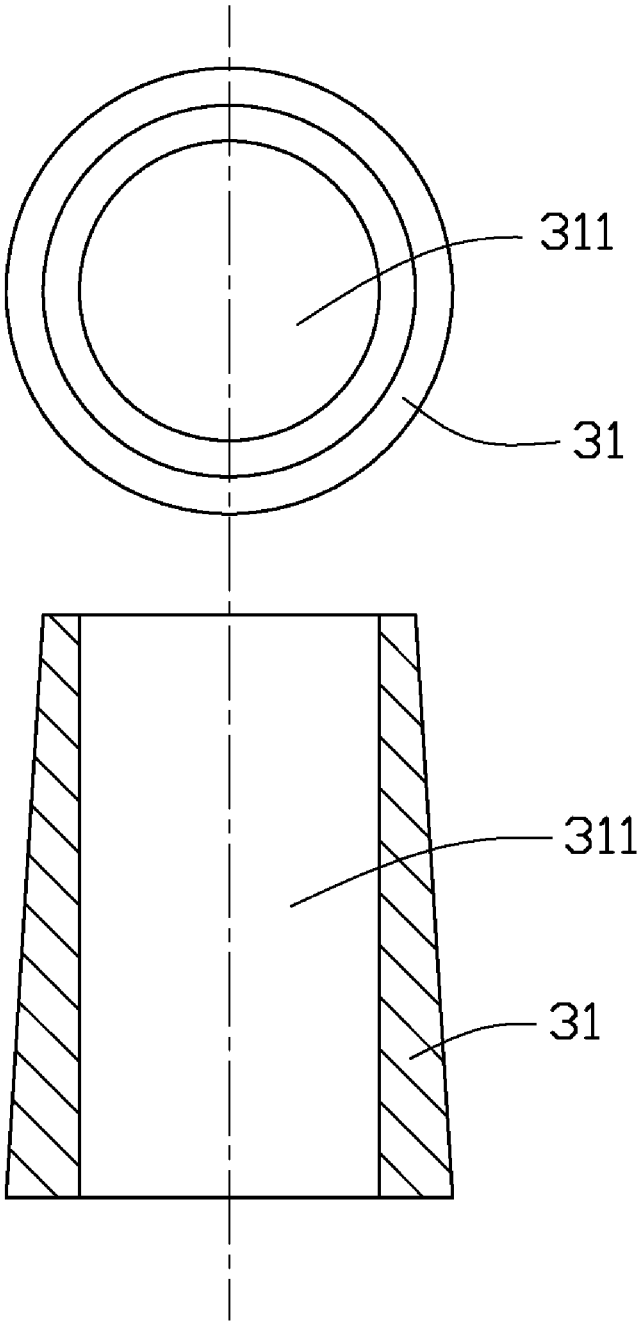

And the sealing element 31 has a melting point less than that of the container 30. Referring to FIGS. 3A-3C, the sealing element 31 may have a quincunx shape, a cylindrical shape, and a tapered shape as shown in FIGS. 3A-3C respectively. The sealing element 31, depending on the shape, should have a greater size than that of the exhaust through hole 301 to fully cover the exhaust through hole 301. In the present embodiment, the sealing element 31 is a tapered shape corresponding to the tapered shape of the exhaust through hole 301, and made of low-melting glass material that has a melting point less than 600° C. The sealing element 31 includes an evacuation passage 311 such as a through hole shown in FIG. 3B and FIG. 3C, or a plurality of notches defined in the periphery thereof shown in FIG. 3A. The evacuation passage 311 allows gas in the pre-packaged container 30 to escape when the sealing element 31 is placed into the exhaust through hole 301 while a vacuum is generated in the pre-packaged container 30.

Figure 4:
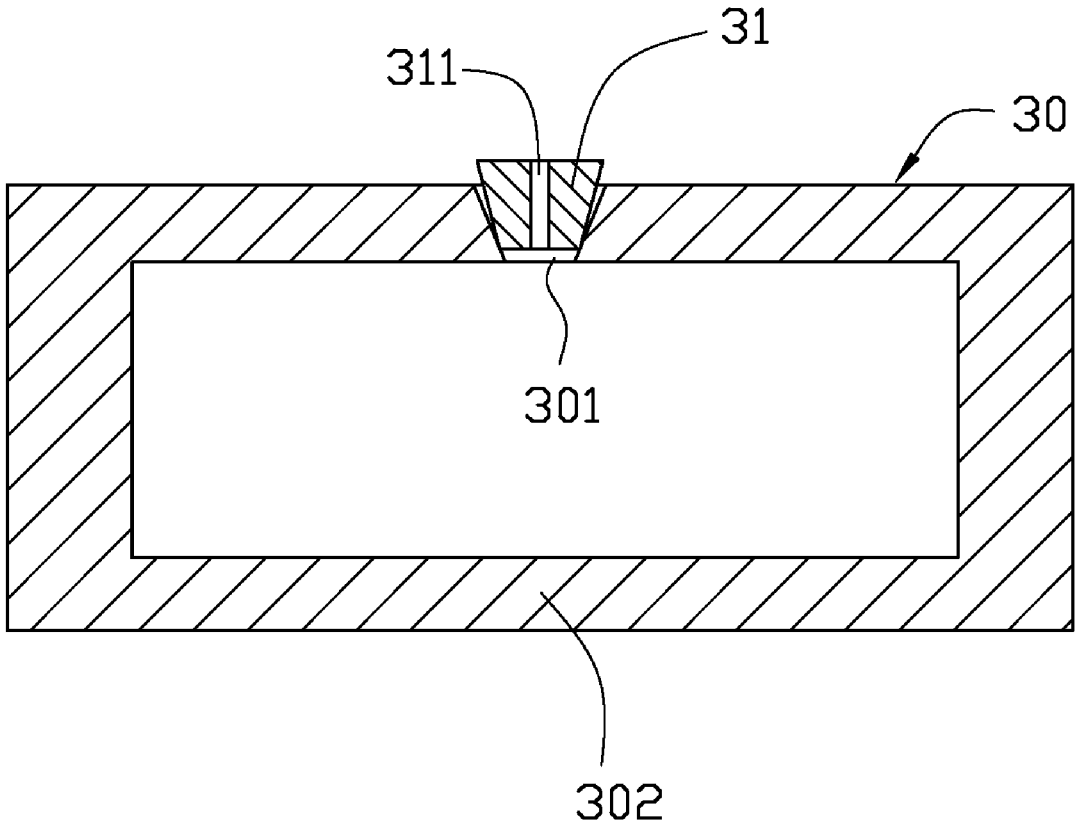
FIG. 4 is a schematic, cross-sectional view of the pre-packaged container and the sealing element.

In step S102, referring to FIG. 4, when the sealing element 31 is placed into the exhaust through hole 301, a packaging precursor of the vacuum device is formed. The packaging precursor includes the pre-packaged container 30 having an exhaust through hole 301 defined therein, and a sealing element 31 placed into the exhaust through hole 301.

Figure 5:
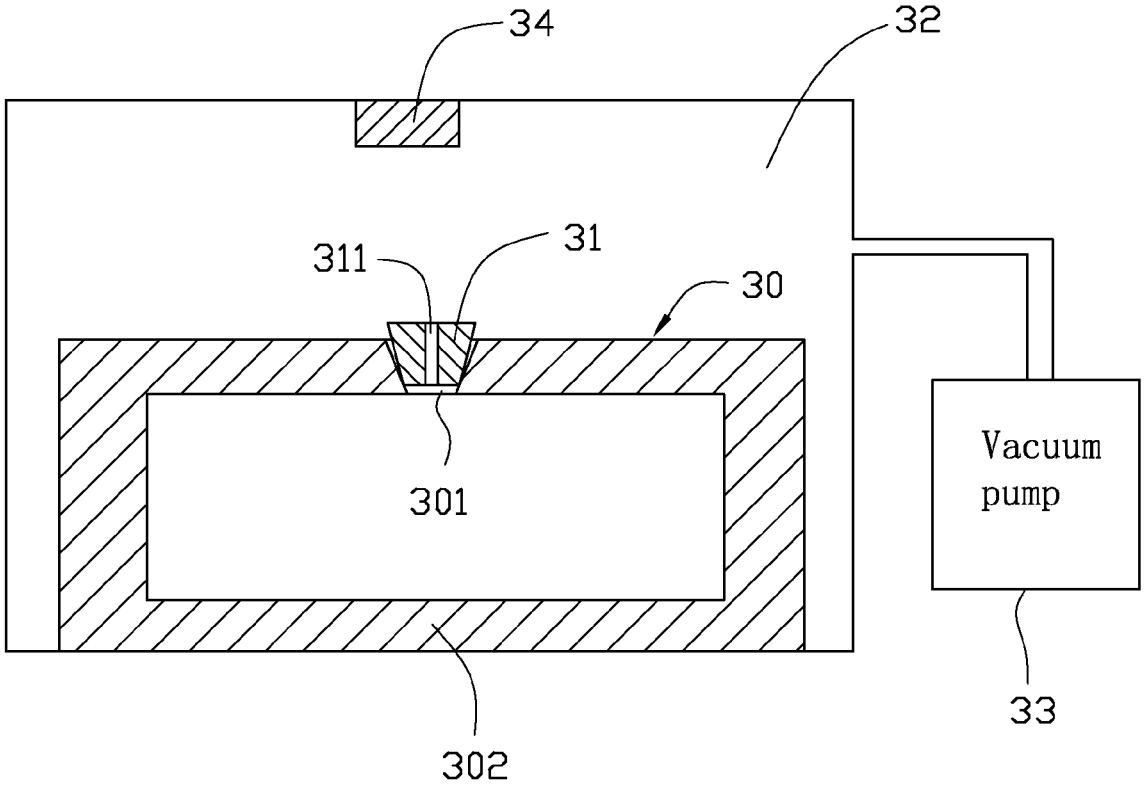
FIG. 5 is a schematic, cross-sectional view of the vacuum device of FIG. 1 contained in a vacuum chamber connected to a vacuum pump.
Figure 6:
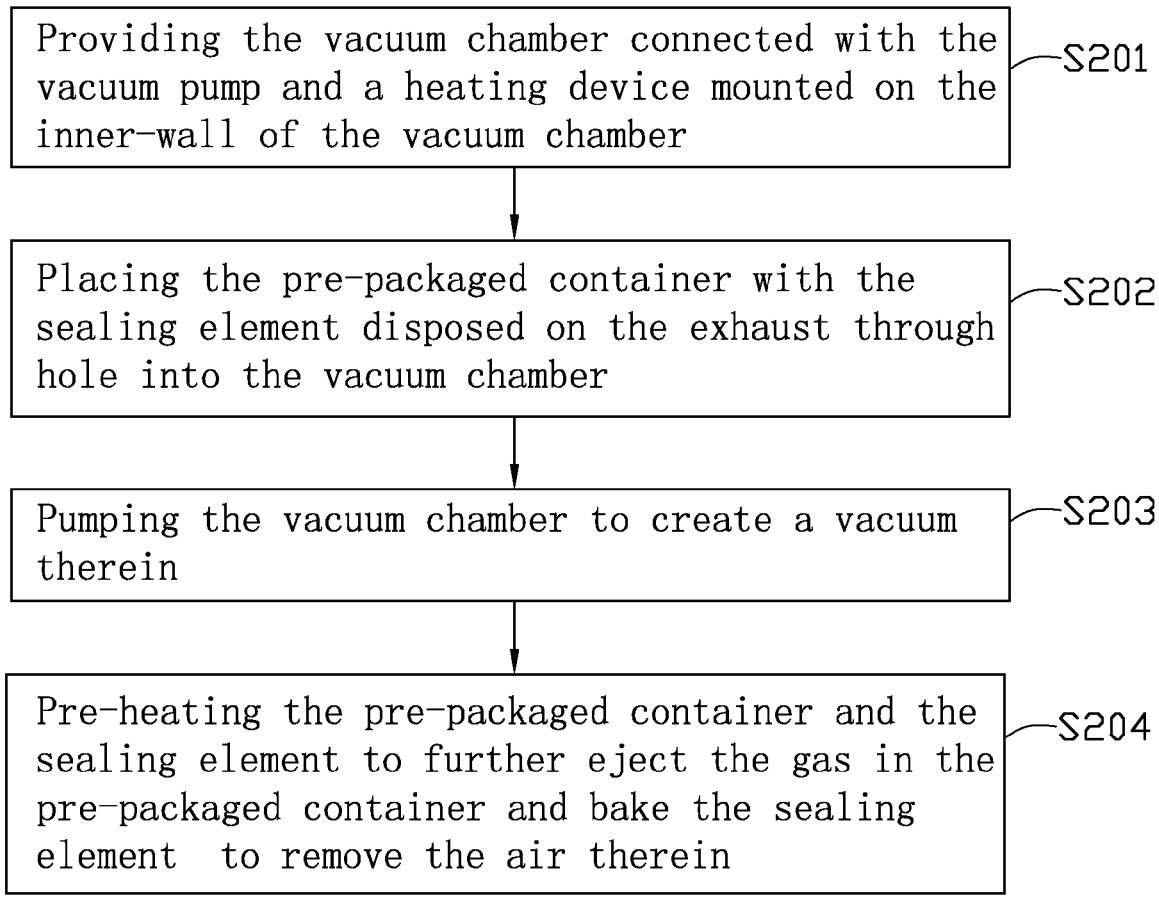
FIG. 6 is a flowchart of a method for exhausting the air of the sealing element.
Figure 7:
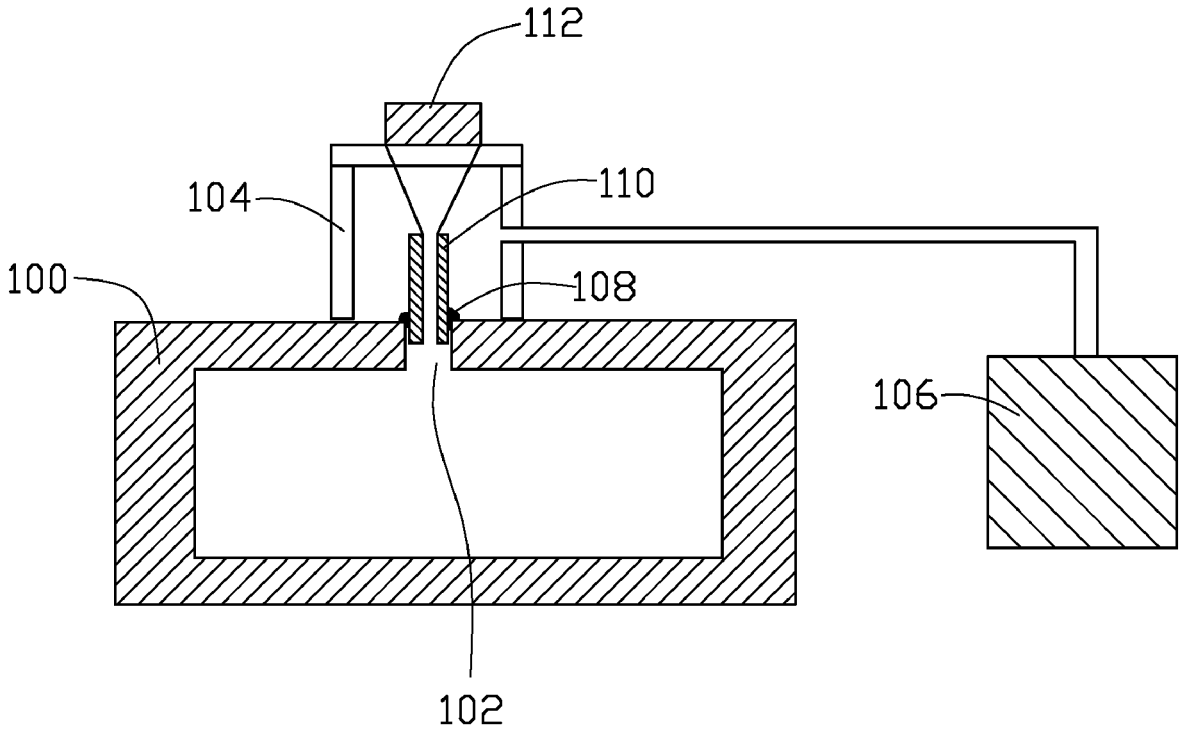
FIG. 7 (RELATED ART)
FIG. 7 is a typical vacuum device that is connected with a vacuum device via a connecting cover.
Figure 8:
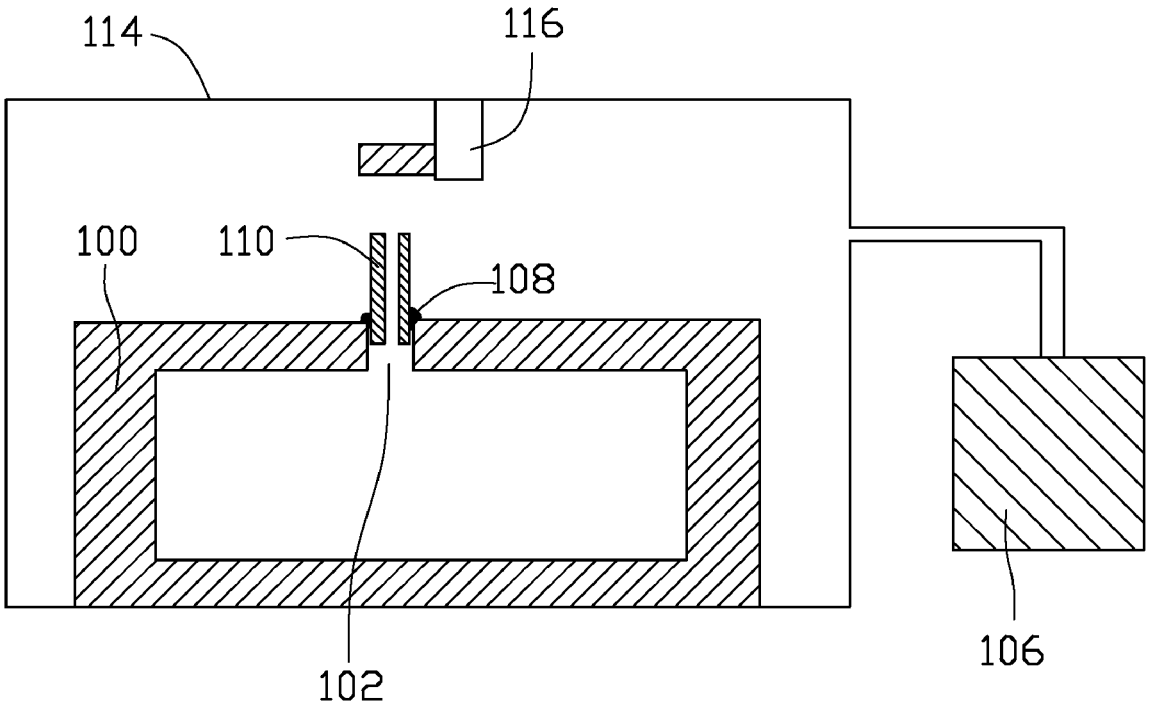
FIG. 8 (RELATED ART)
FIG. 8 is another typical vacuum device that is placed into a vacuum chamber.

In step S103, the pre-packaged container 30 is pumped to create a vacuum via a cup-shaped connector (not shown) or placed in a vacuum chamber 32. For example, the vacuum pump 33 is utilized to remove gases from the pre-packaged container 30 through the cup-shaped connector, which attaches over the exhaust through hole 301. Alternatively, the pre-packaged container 30 also can be accommodated in the vacuum chamber 32. In the present embodiment, referring to FIG. 5, the packaging precursor of the vacuum device is placed into the vacuum chamber 32. When the vacuum chamber 32 is pumped into a predetermined vacuum level, the pre-packaged container 30 will eventually reach the same pressure as the vacuum chamber 32. Referring to FIGS. 5 and 6, the method for pumping the pre-packaged container 30 to create a vacuum therein includes:

step S201: providing the vacuum chamber 32 connected with the vacuum pump 33 and a heating device 34 mounted on the inner-wall of the vacuum chamber 32;

step S202: placing the pre-packaged container 30 with the sealing element 31 disposed on the exhaust through hole 301 into the vacuum chamber 32;

step S203: pumping the vacuum chamber 32 to create a vacuum therein;

step S204: pre-heating the pre-packaged container 30 and the sealing element 31 to further eject the gas in the pre-packaged container 30 and bake the sealing element 31 to remove the air therein.

In step S204, after heating the pre-packaged container 30 and the sealing element 31, the pressure of the pre-packaged container 30 can be further decreased as the gas in the pre-packaged container 30 and the sealing element 31 is further ejected. The heating device 34 may be an electrically heating wire, infrared light and laser.

In step S104, when the sealing element 31 is heated at a predetermined temperature that is higher than the melting-point thereof, it may be softened until it becomes a viscous liquid, thereby effectively sealing the exhaust through hole 301 and the evacuation passage 311 of the sealing element 31. The now, viscous sealing element 31 will not fall into the pre-packaged container 30 because of surface tension.

In step S105, when the heating device 34 has stopped, the temperature of the sealing element 31 decreases as the viscous sealing element solidifies. At the same time, the sealing element 31 is adhered on the exhaust through hole 301 and the evacuation passage 311 is closed. Thus, the pre-packaged container 30 is packaged by the sealing element 31 and has a predetermined internal pressure.

After the packaging process, the vacuum device is obtained. The vacuum device includes the packaged container having the exhaust through hole 301 effectively sealed off by the sealing element 31.

Since the sealing element 31 is used for sealing the exhaust through hole 301 of the pre-packaged container 30, there is no tail of the exhaust pipe retained outside of the packaged container, which is advantageous in regards to safety and reliability. Furthermore, the exhaust through hole 301 has a larger diameter, so that air in the pre-packaged container 30 can be quickly ejected therefrom. Therefore, the structure of the vacuum device becomes simpler and the manufacturing cost is decreased.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

It is also to be understood that above description and the claims drawn to a method may include some indication in reference to certain steps. However, the indication used is only to be viewed for identification purposes and not as a suggestion as to an order for the steps.

What is claimed is:

1. A packaging precursor of a vacuum device, comprising:

a pre-packaged container having an exhaust through hole defined therein, the exhaust through hole having an upper diameter and a lower diameter less than the upper diameter; and a sealing element placed into the exhaust through hole, the sealing element being made of a low-melting point material that has a melting point less than that of the pre-packaged container and having an evacuation passage defined therein to allow gas to escape from the container, wherein the evacuation passage of the sealing element is defined in a periphery of the sealing element, and the sealing element is retained in the exhaust through hole.

2. The packaging precursor of the vacuum device as claimed in claim 1, wherein the pre-packaged container is made of glass or metal.

3. The packaging precursor of the vacuum device as claimed in claim 1, wherein the upper diameter has a diameter of about 10 mm.

4. The packaging precursor of the vacuum device as claimed in claim 1, wherein the lower diameter has a diameter of about 2 mm.

5. The packaging precursor of the vacuum device as claimed in claim 1, wherein the sealing element has one of a quincunx shape, a cylindrical shape, and a tapered shape.

6. The packaging precursor of the vacuum device as claimed in claim 1, wherein the evacuation passage of the sealing element is a through hole.

7. A packaging method for a vacuum device, comprising:

providing a pre-packaged container having an exhaust through hole defined therein, wherein the exhaust through hole has an upper diameter and a lower diameter less than the upper diameter, and a sealing element having an evacuation passage defined therein, wherein the sealing element is made of a low-melting point material that has a melting point less than that of the pre-packaged container and the evacuation passage of the sealing element is defined in a periphery of the sealing element;

placing the sealing element into the exhaust through hole;

pumping the pre-packaged container to create a vacuum therein;

heating and softening the sealing element into a viscous liquid to seal the exhaust through hole; and cooling the packaged container to obtain the vacuum device.

8. The packaging method as claimed in claim 7, wherein the evacuation passage of the sealing element is a through hole.

9. The packaging method as claimed in claim 7, wherein the method for pumping the container to create a vacuum therein comprises:

providing a vacuum chamber connected to a vacuum pump and a heating device mounted on an inner-wall of the vacuum chamber;

placing the pre-packaged container and the sealing element located on the exhaust through hole of the pre-packaged container into the vacuum chamber;

pumping the vacuum chamber to the predetermined vacuum level to create a vacuum therein; and pre-heating the pre-packaged container and the sealing element to further eject the gas in the pre-packaged container and baking the sealing element to remove the air therein.

* * * * *